United States Patent [19]

Mellott

[11] 4,249,585

[45] Feb. 10, 1981

[54] LOG DEBARKING APPARATUS

[76] Inventor: Hayes R. Mellott, 13529 Long La., Mercersburg, Pa. 17236

[21] Appl. No.: 31,636

[22] Filed: Apr. 19, 1979

[51] Int. Cl.[3] ..... B27L 1/04

[52] U.S. Cl. ..... 144/208 G; 144/311

[58] Field of Search ..... 144/208 G, 311

[56] References Cited

U.S. PATENT DOCUMENTS

| | | | |
|---|---|---|---|
| Re. 26,535 | 3/1969 | Mellott et al. | 214/91 |
| 2,016,069 | 10/1935 | Britton | 144/209 |
| 2,611,401 | 9/1952 | Burton | 144/208 G |
| 2,681,670 | 6/1954 | Prentice | 144/208 G |
| 2,901,011 | 8/1959 | Eaton | 144/208 F |
| 2,902,070 | 9/1959 | Latimer | 144/208 G |
| 3,008,503 | 11/1961 | Hilborn | 144/208 G |
| 3,017,911 | 1/1962 | Fulghum | 144/208 G |
| 3,082,801 | 3/1963 | Dillingham | 144/208 G |
| 3,159,192 | 12/1964 | Normantas | 144/242 |
| 3,176,734 | 4/1965 | Broadbent | 144/208 G |
| 3,267,976 | 8/1966 | Keeney | 144/208 G |
| 3,351,109 | 11/1967 | Schurman | 144/208 |
| 3,987,825 | 10/1976 | Vignolles | 144/208 F |

*Primary Examiner*—Willie G. Abercrombie

*Attorney, Agent, or Firm*—James L. Bean

[57] ABSTRACT

A log debarker employing a log supporting and turning apparatus for rotating a log at a fixed location as a rotary debarking tool is moved along the rotating log so that the tool traverses a spiral path over the log's surface to completely remove the bark from the log, after which the log is rolled from the apparatus. The debarking tool is supported on a carriage which is moved along a single track extending closely adjacent the log supporting and turning apparatus, and stabilizing guides are provided to maintain the carriage in an upright position on the single track. The log rolls, by gravity, over the single track as it is removed from the apparatus.

15 Claims, 7 Drawing Figures

LOG DEBARKING APPARATUS

BACKGROUND OF THE INVENTION

1. Field of the Invention

This invention relates to log debarking apparatus and more particularly to an improved mechanical log debarking apparatus particularly well adapted for use in stationary installations.

2. Description of the Prior Art

Modern commercial lumbering operations conventionally remove the bark from logs before the logs are processed as by sawing into lumber or being chipped for pulping. Numerous debarking devices have been developed, including hydraulic apparatus which remove the bark by use of high pressure water jets and mechanical devices which employ a driven tool head to remove the bark by a beating or scraping action. The mechanical debarking devices currently in use generally employ means for supporting and rotating a log about its longitudinal axis with a driven tool head engaging the log as it rotates to remove the bark. Either the log or the tool head is moved longitudinally of the log as the log rotates so that the tool head progressively removes the bark around a spiral path which completely traverses the outer surface of the log.

The commercially available log debarking devices are generally effective in removing the bark and can be operated at substantial savings over the manual debarking methods previously widely used. However, known devices have not been entirely satisfactory for various reasons. For example, debarking devices which progressively move a log past a debarking head are very large and expensive and require excessive space due to the fact that the apparatus must be more than twice the length of the longest log to be processed through the apparatus. In devices where the logs are rotated in position and the tool head is moved progressively along the length of the logs, it has generally been the practice to mount the tool head on a track arrangement extending outboard of the log support. In such an arrangement, the track extends longitudinally beyond the log support a distance sufficient to permit the tool head to be moved out of the way of a log being loaded onto or unloaded from the log support. However, this arrangement has generally resulted in a substantial increase in apparatus width over that of the stationary tool head type of apparatus, and difficulty has been encountered in removing a debarked log from the apparatus over the tool head carriage track. It is, accordingly, a primary object of the present invention to provide an improved log debarking apparatus.

It is another object of the present invention to provide an improved heavy-duty, compact, mechanical type log debarking apparatus.

Another object of the present invention is to provide such a log debarking apparatus in which the debarking tool head is moved along a track extending closely adjacent one side of the apparatus, and in which the track does not materially interfere with the removal of logs from the apparatus.

BRIEF SUMMARY OF THE INVENTION

In the attainment of the foregoing and other objects and advantages of the present invention, an important feature resides in providing a plurality of log support rolls mounted on spaced parallel shafts for supporting and rotating a log to be debarked. Logs may be loaded directly onto the support wheels from one side of the apparatus and unloaded, after being debarked, on the other side. A debarking tool support frame is mounted on a single support track structure positioned closesly adjacent one side of the log support apparatus to support the tool carriage for movement along the length of the apparatus. The carriage is supported on contoured wheels which engage a contoured surface on the single track to vertically support the carriage and tool head, and guide rolls on the carriage engage the bottom and side surfaces of the track to maintain the carriage in position on the track. The size and position of the track are such as to provide minimal interference with the removal of the debarked log from the apparatus.

The construction of the tool head carriage is also very compact, enabling a further reduction in the complexity and size of the apparatus. If desired, the debarking apparatus can be employed in juxtaposition to a sawmill so that logs can be unloaded by a suitable kicker bar arrangement mounted directly on the debarking apparatus, onto the carriage of a sawmill. A suitable loader apparatus, such as the live deck and loader assembly shown in U.S. Pat. No. Re. 26,535, can be employed to load logs, one at a time, onto the debarking apparatus. Similarly, the order of arrangement may be reversed, i.e., debarked logs may be discharged from the debarking apparatus and stored on a live deck arrangement for subsequent feeding onto a sawmill carriage. Alternatively, the apparatus may be operated independently for debarking logs which are ultimately utilized at a remote location.

BRIEF DESCRIPTION OF THE DRAWINGS

Other objects and advantages of the apparatus according to the present invention will become apparent from the detailed description contained hereinbelow, taken in conjunction with the drawings, in which.

DESCRIPTION OF THE PREFERRED EMBODIMENTS

Figure 1:
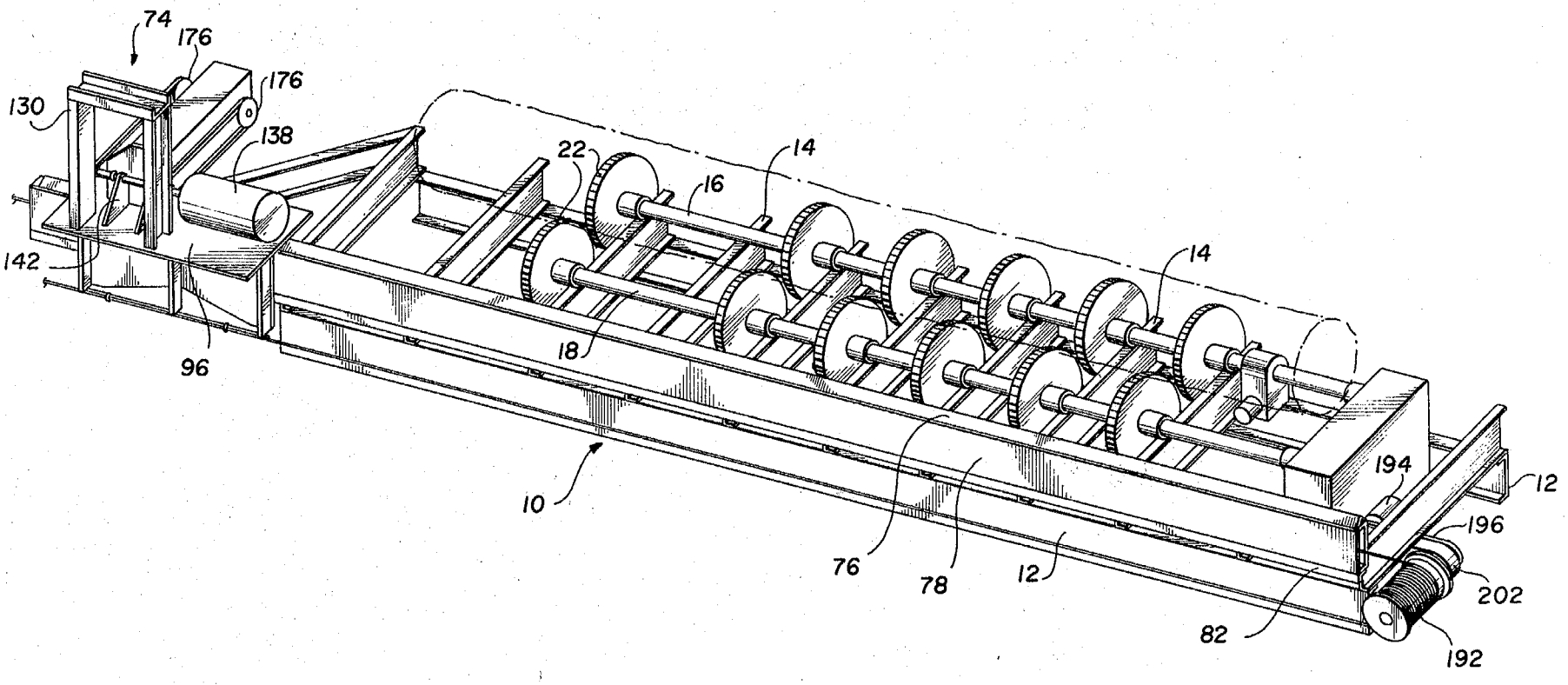
FIG. 1 is an isometric, partially schematic view illustrating a log debarking apparatus in accordance with the present invention.

Referring now to the drawings in detail, a log debarking apparatus according to the present invention is designated generally by the reference number 10, and includes a rigid frame including a base made up of a pair of elongated parallel laterally spaced structural channel members 12 and a plurality of cross beam members 14 rigidly joined, as by bolting or welding, to the top of base channels 12. A pair of elongated shafts 16, 18 are mounted in parallel, laterally spaced relation to one another on top of the cross beams 14 for rotation about axes extending generally parallel to the base channels 12, by a plurality of journal bearings 20. A plurality of log support wheels 22 are mounted on each of the shafts 16 and 18 for rotation therewith, with one wheel preferably being mounted adjacent each journal bearing 20.

Figure 3:
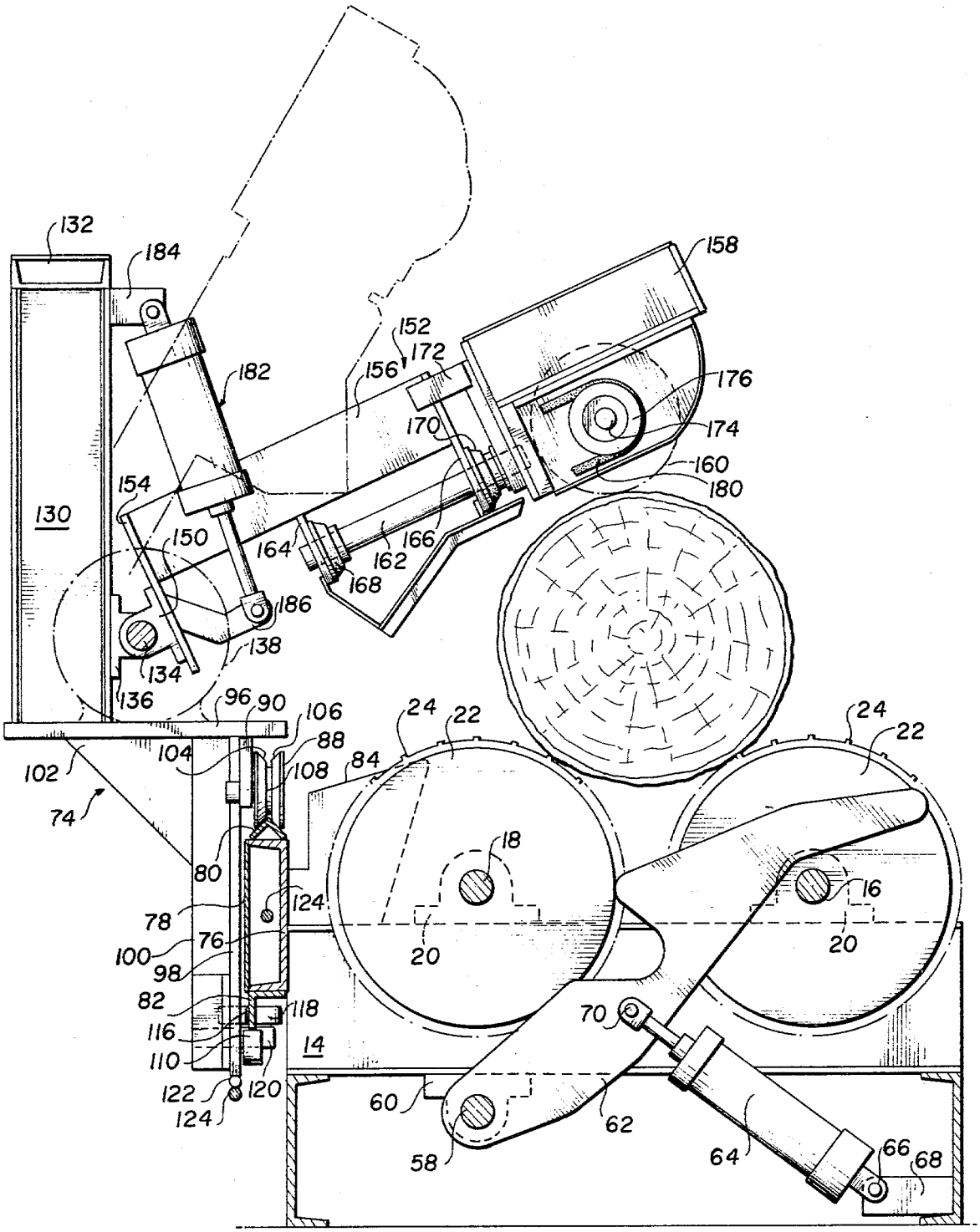
FIG. 3 is a sectional view, on an enlarged scale, showing the apparatus in use to debark a log.
Figure 5:
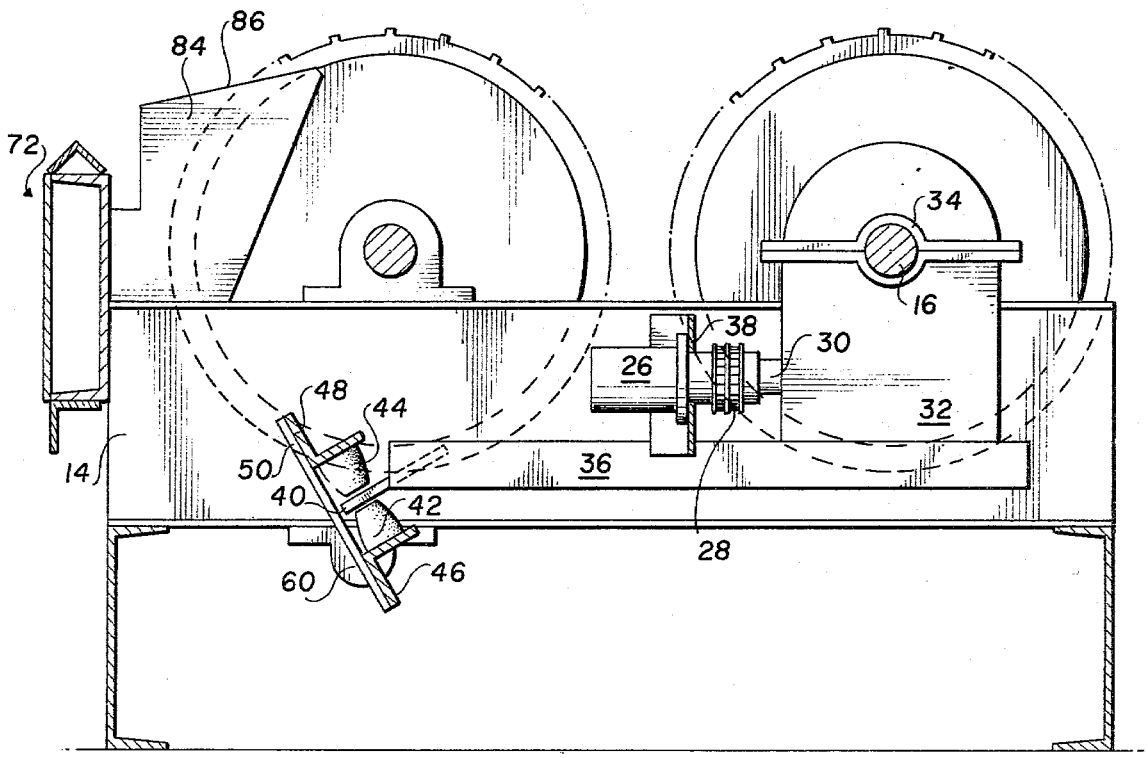
FIG. 5 is a sectional view, taken on line 5—5 of FIG. 2.

As best seen in FIGS. 3 and 5, log support wheels 22 have a plurality of cleats, or projections 24 formed on their outer periphery, at spaced intervals therearound, to provide friction for engaging the outer surface of a log to rotate the log about its axis in a manner described hereinbelow. The spacing of the shafts 16, 18 relative to one another, and the diameter of the log support wheels 22 are such that the top portions of the wheels cooperate to form a trough-like support for a log to be debarked on the apparatus. Shaft 16 is driven for rotation by a hydraulic motor 26 which, acting through a flexible coupling 28 and shaft 30, provides the power input to a reduction gear mechanism contained in a housing 32 mounted directly on and suspended from the shaft 16. Shaft 16 is journaled for rotation within the housing 32 by suitable journal bearings 34, and rotation of housing 32 around the axis of its supporting shaft is prevented by an elongated torque bar 36 having one end rigidly mounted on the bottom portion of reduction gear housing 32. Torque bar 36 extends transversly of the frame and terminates in a free end located at a position below shaft 18. A rigid bracket 38 mounted on torque bar 36 supports motor 26.

Torque bar or arm 36 terminates at is free end in a flat plate member 40, which extends between a pair of spaced, resilient bumpers 42, 44 supported by angle members 46, 48, respectively, mounted to a bracket 50 rigidly joined to one of the cross beams 14 of the apparatus frame. Resilient bumpers 42, 44 are normally spaced from the plate 40 to permit limited movement of the torque arm 36 about the axis of shaft 16. Further rotational movement of the torque bar is limited by the bumpers which act as a shock absorber to protect the drive system from adverse effects of heavy sudden loads which may result when a large log is being rotated on the support wheels or during the loading or unloading of a log from the apparatus. In the no-load condition, the weight of the drive assembly, with its center of gravity spaced substantially below the axis of shaft 16, is sufficient to provide the reaction force for driving the shaft 16 without restraint from the torque bar structure.

Figure 2:
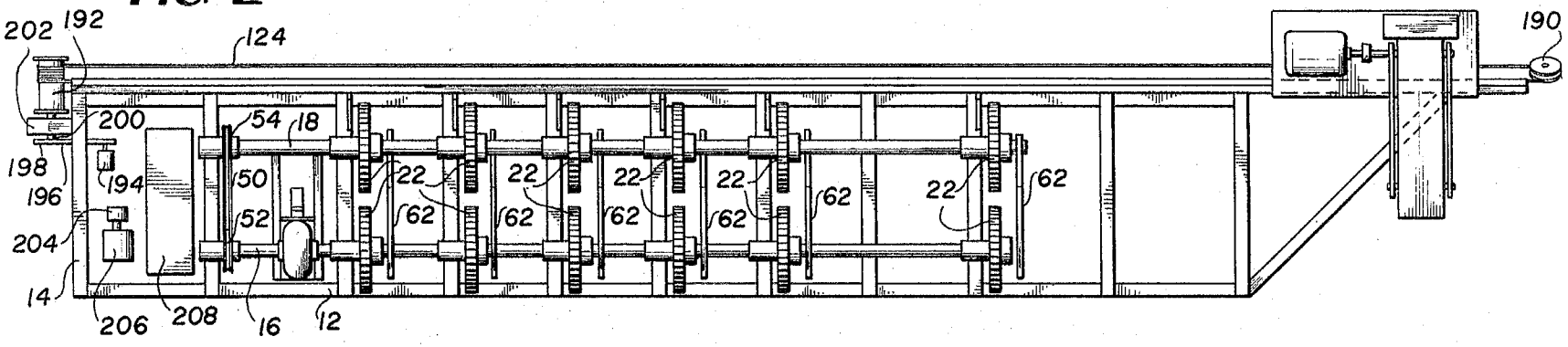
FIG. 2 is a top plan view of the apparatus shown in FIG. 1.
Figure 7:
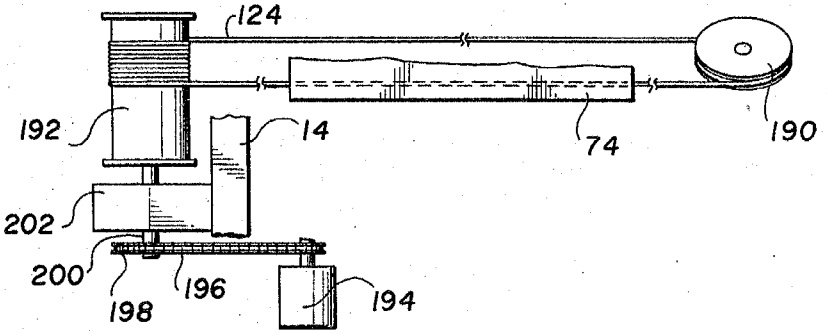
FIG. 7 is a fragmentary top plan view showing the drive means for moving the tool carriage along its support track.

As seen in FIG. 2, shaft 18 is driven for rotation about its axis by a chain 50 extending around a sprocket 52 on shaft 16 and a corresponding sprocket 54 on shaft 18.

A third elongated shaft 58 is mounted on the bottom edge portions of cross beams 14 by a suitable journal bearing 60. Shaft 58 is positioned directly beneath shaft 18, and a plurality of elongated kick-off arms 62 each have one end mounted on shaft 58 for rotation therewith, and their other end projecting upwardly between shafts 16 and 18. A fluid cylinder actuator 64 has its cylinder end pivotally connected, as by pin 66 and bracket 68, to one of the channel members 12 and its piston end connected, as by pin 70, to one of the kick-off arms intermediate its ends. Extension and retraction of the piston of actuator 64 will rotate the kick-off assembly to move the arms 62 between a lowered inactive position shown in FIG. 3 and a raised position to kick or push a log over the top, or crest, of the support rolls 22 on shaft 18 when the log is debarked. The length and contour of the kick-off arms 62 are such as to enable retraction of the arms below the periphery of the support wheels in the lowered position to permit a log to be rolled onto the apparatus over the wheels 22 supported by shaft 16. In the raised position, the kick-off arms project upwardly to a point spaced substantially above shaft 18 to positively remove a log from the support rolls. If desired, a plurality of the fluid cylinders 64 may be employed. The kick-off arms are preferably located one adjacent each pair of support rolls as indicated in FIG. 2.

An elongated tool head carriage support track assembly 72 is rigidly mounted on and projects above the end portions of cross beams 104 at one side of the debarker assembly frame. As best seen in FIGS. 3 and 5, the carriage track assembly 72 is a fabricated structure made up of a plurality of rigidly welded structural steel members to provide both vertical and lateral support for a tool head carriage assembly 74. As shown, track assembly 72 may consist of a structural steel channel 76 having its web disposed in a vertical plane and rigidly joined to the end portions of the cross beams 14. The flanges of channel 76 project laterally outward from the frame assembly and have a plate 78 rigidly welded to their free edges to form a hollow tubular structure. A structural angle 80 has the free edges of its two legs rigidly welded to the top flange of channel 76, with the angle 80 defining an upwardly directed track surface in the configuration of an inverted V. A second structural angle 82 has one leg rigidly joined in overlying relation with the bottom flange of channel 76 and its other leg extending vertically downward from the outwardly directed edge of the channel flange. As indicated in FIGS. 1 and 2, track assembly 72 extends along the full length of the log support portion of the debarker frame and projects beyond the frame at one end thereof a distance to permit the debarker tool head carriage to be moved to and stored at a position out of the path of a log being removed from the apparatus by operation of the kicker assembly.

The top edge of the carriage track assembly extends substantially below the top peripheral edge of the support wheels 22, and a plurality of support brackets 84 are rigidly joined, as by bolts and angle brackets, not shown, to the top surface of the cross beams 14 and to the adjacent web of structural channel 76 to further strengthen the track assembly. Also, the top edge 86 of the brackets 84 extend from a position slightly below the top peripheral portion, or crest; of the log support wheels 22 which are mounted on shaft 18 to a position spaced above and inwardly from the top of the track assembly. The edges 86 are inclined downwardly toward the track to act as a ramp for debarked logs being rolled off of the debarker assembly. Thus, the brackets 84 support logs being removed until they reach a position where they can roll, by gravity, completely over the narrow carriage track assembly without either being caught and held by the track or damaging the track structure. Thus, the logs can roll directly over the track onto a sawmill carriage, or onto skid bars positioned outboard of the track assembly for transfer onto such carriage or for removal to a remote location. Alternatively, the logs may be rolled onto a live deck structure, as described above, for subsequent feeding onto a sawmill carriage.

The tool head carriage 74 includes a frame structure supported for movement along the track assembly 72 by a pair of support rollers, or wheels, 88 mounted for rotation on horizontally extending stub axles 90 supported on brackets 92 as by clamping nuts 94. Brackets 92 project downwardly, one from each end portion of a horizontal platform 96. A vertically extending plate 98 is rigidly welded to and projects downwardly from the bottom surface of platform 96 adjacent the outer surface of track assembly 72. Plate 98 is reinforced by three vertically extending flat metal bars 100 rigidly welded to its surface on the side opposite the track 72, with the top ends of bars 100 also being rigidly welded to the bottom surface of platform 96. Bars 100 are located one adjacent each end portion of the plate and one substantially at the center thereof. Also, as shown in FIG. 3, a plurality of gusset plates 102 are welded between the outwardly directed edges of bars 100 and the bottom surface of platform 96 to further rigidify the assembly.

The support wheels 88 are formd with a substantially V-shaped groove around their outer periphery to provide inclined rim surfaces 104, 106 engaging and rolling upon the flat inclined surfaces of structural angle 80 as the carriage moves back and forth along the track assembly. Preferably, a groove 108 is also formed at the bottom of the V-shaped notch in wheel 88 to minimize the effect of small foreign articles such as chips of bark or the like which may become trapped between the wheel and track.

Figure 4:
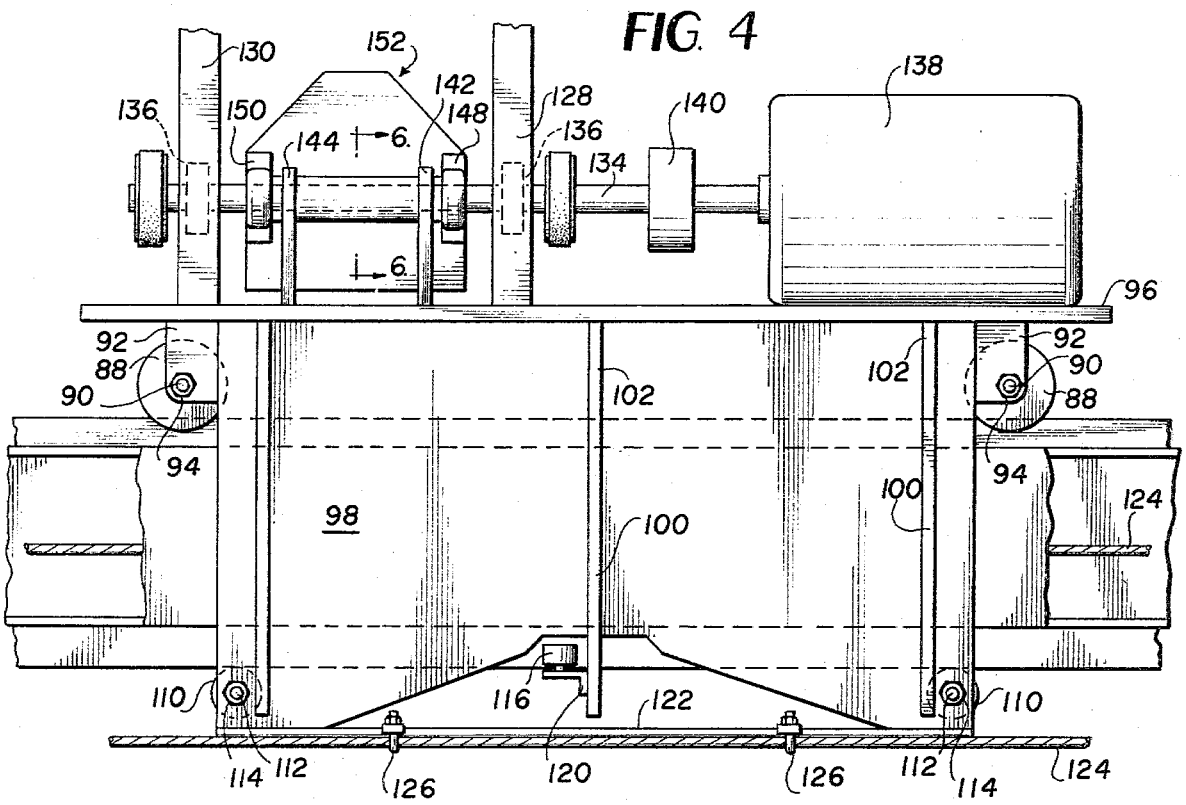
FIG. 4 is a fragmentary elevation view of a portion of the structure shown in FIG. 3 and illustrating the debarker carriage support structure.

In order to maintain the carriage in an upright position and to prevent its wheels 88 from being lifted off of the track assembly, a pair of guide rolls 110 are mounted on plate 98 for rotation about horizontal stub axles 112 located one adjacent each bottom corner portion of the plate retained thereon by nuts 114. Guide rolls 110 are positioned to engage the downward directed edge surface of the vertical leg of structural angle 82 on the bottom of the track assembly 72. A second pair of guide rolls 116, 118 are mounted for rotation about spaced vertical axes on an angle bracket 120 rigidly supported on the bottom end of the flat bar 100 located in the center portion of plate 98. Guide roll 116 is positioned to engage the outer surface of the downwardly projecting leg of angle 82, i.e., the surface directed away from the cross beams 14, and roller 118 is positioned to engage the inner surface of the angle leg in direct opposition to roll 116. Thus rolls 116 and 118 provide lateral stability for the carriage by preventing any tilting movement of the carriage 74 around the track assembly, while the two rollers 110 provide vertical stability by preventing lifting of the carriage assembly. Thus, the V-shaped groove of the carriage wheels 88 are positively maintained in contact with the contoured track surface defined by the upwardly directed surfaces of the legs of structural angle 80. As seen in FIG. 4, the bottom edge of plate 98 has a cutout in the general shape of an inverted, shallow V formed in its central portion to provide access to rollers 116 and 118 and to the support bracket 120.

An elongated metal rod 122 extends between and is rigidly welded to the end portions of the bottom edge of plate 98. Rod 122 preferably has a rough or uneven surface and may be conventional concrete reinforcing rod or threaded rod. A cable 124 is employed to drive the carriage along the track assembly and is attachd to rod 122 by a plurality of cable clamps 126 which firmly clamp the cable and rod 122 to one another. The arrangement for driving cable 124 to moe the carriage 74 along the track 72 is described hereinbelow.

An A-frame assembly consisting of a pair of vertical columns 128, 130 and a cross beam 132 is rigidly mounted on and projects upwardly from one end portion of the horizontal platform 96. A drive shaft 134 is journaled for rotation about a horizontal axis by a pair of journal bearings 136 mounted one on the side face of each of the columns 128, 130. A drive motor 138 is operably connected to shaft 134 by a suitable coupling member 140.

Figure 6:
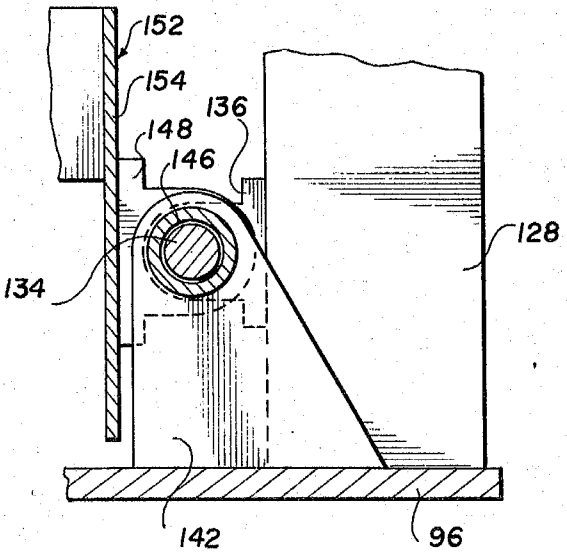
FIG. 6 is an enlarged, fragmentary sectional view taken on line 6—6 of FIG. 4.

A pair of debarker head frame support plates 142, 144 are welded to and project upwardly from the top surface of platform 96 at spaced points intermediate the columns 128, 130, and a tubular sleeve 146 extends through the top portion of the plates with the opposed ends of the sleeve projecting from the plates in the direction of the A-frame columns 128, 130. As best seen in FIG. 6, the drive shaft 134 extends through but does not contact the inner surface of sleeve 146. A pair of journal bearings 148, 150 are mounted one on each projecting end of sleeve 146 for rotation thereon about the common axis of the sleeve and shaft 134.

A debarker tool head support arm or frame, indicated generally at 152, is mounted on bearings 148, 150 for pivotal movement about the common axis of drie shaft 134 and sleeve 146. The support frame 152 includes a mounting plate 154 supported on bearings 148, 150, cantelevered beam 156 is rigidly welded on and projects outwardly from plate 154 above the track assembly 72 to support a tool head assembly 158, including a rotary debarking tool 160. Tool head 158 is supported on beam 156 for pivotal movement about an axis extending generally transversly of the axis of shaft 134 (and therefore of a log on the support wheels 22) by a shaft 162 mounted in support brackets 164, 166 projecting downwardly from beam 156. A pair of thrust bushings 168, 170 support shaft 162 and provide both rotary and axial support for the tool head. Stop members 172, mounted on the tool head assembly in position to engage the end of beam 156, limit the pivotal moement of the tool head about the axis of shaft 162.

The debarking tool 160 is supported for rotation by a shaft 174 extending generally parallel to the axis of a log to be debarked when the log is supported on the wheels 22. Shaft 174 also normally extends parallel to drive shaft 134, and a pair of pulleys 176 are mounted one on each end of the shaft 174. A corresponding pair of drie pulleys 178 are mounted on the drive shaft 134, one in alignment with each of the pulleys 176, and a pair of belts 180 extend over the aligned pairs of pulleys to rotate the tool head about the axis of shaft 174 upon rotation of shaft 134 by motor 138.

The debarking tool head and support assembly can be moved between a raised position illustrated in broken line in FIG. 3 and a lowered, operating position in which the driven tool 160 is urged into engagement with a log supported on the apparatus by a hydraulic actuator 182. The actuator 182 has its cylinder end pivotally connected to a bracket 184 adjacent the top of the A-frame assembly and its rod end pivotally connected to a rigid arm 186 mounted on and projecting outwardly from the plate 154 beneath and to one side of the support beam 156. During operation of the debarker, hydraulic pressure applied to the top end of the cylinder will apply a substantially constant, yet yielding force urging the tool head support downwardly to maintain the rotating tool 160 in contact with a log supported on and rotated by the wheels 22. A bark deflecting shield 188 is supported on the tool head support by brackets 164, 166 to deflect any flying pieces of removed bark downwardly so that the bark falls through the open frame structure where it may be removed by a suitable conveyor or other means, not shown. Also, suitable shields may be provided on and carried by the carriage assembly 74 to prevent pieces of bark and other debri from collecting on the platform 96 or the track assembly 72.

The carriage 74 is moved along track assembly 72 by the endless cable 124 which extends over a guide sheave 190 mounted on the end of the track assembly which projects past the debarker frame. Also, a number of turns of the cable are wrapped around a winch drum 192 supported at the opposie end of the track 72. Drum 192 is driven by a reversible hydraulic motor 194, acting through a chain 196 and a sprocket 198 mounted on the shaft 200 which supports the drum 192. Shaft 200 is journaled in suitable bearings in a support bracket 202 mounted on the cross beam 14 at the end of the track 72. The top run of cable 124 extends through the hollow interior of the track assembly 72. Hydraulic fluid is provided to the hydraulic power equipment of the apparatus by a pump 204 driven by an electric motor 206 mounted on the base frame structure. A hydraulic fluid resevoir 208 is provided adjacent the pump 204.

In operation of the debarking apparatus described above, hydraulic motor 194 is driven in a direction to drive cable 124 and the carriage 74 to the loading and unloading position on the extended portion of track 72 as shown in FIG. 2. A log to be debarked is then rolled into position on the support wheels 22 from the side of the frame opposite track 72, and wheels 22 are rotated by hydraulic motor 26, acting through the reduction gear drive in housing 32. Since the wheels on shafts 16 and 18 are both rotated in the same direction, and since shafts 16 and 18 are parallel, the log will be rotated about is longitudinal axis while remaining in a substantially fixed location on the apparatus. With the debarking tool support arm in the raised position, motor 194 is then operated to move carriage 74 to bring the debarking tool into position directly above one end of the rotating log. Cylinder 182 is then actuated to urge the debarking tool into contact with the log and motor 128 is energized to drive the debarking tool about its axis. As the debarking tool is driven, motor 194 is also operated at a rate to progressively move the carriage and the debarking tool along track 72 so that the debarking tool traverses a spiral path around the log rotating thereunder to engage and remove the bark from the complete outer surface of the log. To assure positive removal of the bark, fluid pressure is applid to the cylinder 182 to maintain a predetermined load on the rotating tool. Any surface irregularities such as knots or the like on the log can be accommodated by the tool head, both as a result of the pivotal mounting of the tool head about shaft 162 and the resilient force of cylinder 182. Tensile force in the belt 180 will normally retain the shaft 174 in the horizontal position, but the bolts are sufficiently resilient to permit limited pivotal movement about shaft 162 to accommodate normal surface irregularities in the log being debarked.

When the debarking tool has traversed the complete outer surface of a log supported on wheels 22, cylinder 182 is actuated to raise the debarking tool from engagement with the log, and motor 194 is reversed to drive the carriage to the retracted position. Log support wheels 22 can then be stopped, and the kick-off mechanism is actuated by applying fluid pressure to the cylinder 64 to raise the kick-off arms or bars 62 to roll the debarked log over the crest of the wheels 22 supported on shaft 18. Once the log is rolled past the crest, it will continue to roll by gravity down the inclined ramp defined by the top edges of the brackets 84 and over the edge of the rigid, narrow track assembly 72 onto suitable skid bars or the like as described hereinabove. The kick-off arms 62 are then retracted and another log can be rolled onto the support wheels and the operation repeated.

It is apparent that the rigid, very narrow track structure 72 mounted immediately adjacent the side edge of the frame structure of the debarker apparatus greatly facilitates removal of logs from the debarking apparatus. This arrangement also conserves space in confined areas such as when the debarker is used in conjunction with a sawmill or the like. This narrow track arrangement also facilitates mounting of the debarking head support frame 152 closely adjacent the edge of the log support frame structure so that a relatively short, pivoted debarker head support frame can be employed to debark logs varying in size from relatively small pulp logs to logs of three feet or more in diameter. The drive arrangement for the debarker tool, with the drive shaft 134 being concentric with the pivot mounting for the head support 152, also facilitates and simplifies the mounting structure for the tool support since movement of the head support about its pivotal axis will not affect the tension of the drive belts. Further, the use of belts, which may be conventional V-belts, inherently provides some flexibility so that the tool head can pivot, within limits, about the shaft 162 to accommodate surface irregularities in the log.

It is believed apparent that various modifications could readily be made to the structure disclosed. For example, while the substantially right-angled carriage track surface and the generally V-shaped carriage wheel surface is preferred configuration, other generally complementary surface configurations could readily be employed. Similarly, the guide wheel structure at the bottom of the carriage could take the form of a low-friction, sliding cam, or a single cam follower which could be positioned between opposed flanges of a channel to provide lateral stability in both directions. Thus, while I have disclosed and described a preferred embodiment of my invention, I wish it understood that I do not intend to be restricted solely thereto, but rather that I do intend to include all embodiments thereof which would be apparent to one skilled in the art and which come within the spirit and scope of my invention.

I claim:

1. A log debarking apparatus comprising, an elongated rigid structural frame, log supporting and turning means on said structural frame for supporting a log at a substantially fixed location while rotating the log about its axis, a driven rotary debarking tool for removing bark from a log being rotated on said supporting and turning means, a debarker tool carriage supporting the debarking tool for movement along the length of a log being rotated on the log supporting and turning means, track means for supporting the carriage for movement along a path substantially parallel to and spaced from a log on said log supporting and turning means, said track means including an elongated structural member extending along one side of said structural frame and having a single upwardly directed carriage support track on its top surface, and lateral stabilizing guide means extending parallel to and spaced substantially below said carriage support track, said debarker tool carriage including a carriage frame, a pair of carriage support wheels mounted in tandem on said carriage frame and positioned to engage said single carriage support track to support said carriage for movement therealong, movable tool support arm means mounted on said carriage frame above said carriage support wheels and projecting laterally from said track means in position to support the debarker tool above said structural frame, and guide follower means on said carriage frame and engaging said lateral stabilizing guide means, said lateral stabilizing guide means and said guide follower means cooperating with said single carriage support track and said carriage support wheel to provide the sole support for said carriage and stabilize the carriage against tilting movement about said single carriage support track, and means for driving the carriage along said carriage support track.

2. A log debarking apparatus as defined in claim 1 wherein said carriage support track has a contoured upwardly directed track surface, and wherein said carriage support wheels each have their outer rim contoured to provide a substantially complimentary fit onto said contoured upwardly directed track surface.

3. A log debarking apparatus as defined in claim 2 further comprising vertical hold-down means for retaining said carriage support wheels against substantial vertical movement relative to said track means, the contoured track surface and the contoured rims on said carriage support wheels cooperating with said vertical hold-down means to maintain said carriage support wheel on said carriage support track.

4. The log debarking apparatus as defined in claim 3 wherein said log supporting and rotating means comprises a pair of elongated shafts mounted on said structural frame in laterally spaced parallel relation to one another and to said carriage support track and a plurality of log support wheels mounted on each of said elongated shafts, said apparatus further comprising log removing means for engaging and pushing a log from the supporting and rotating means over the crest of the log support wheels mounted on the shaft closest said track means.

5. The log debarking apparatus as defined in claim 4 wherein said carriage support track is spaced below the crest of said log support wheels, and wherein said apparatus further comprises ramp means extending from a position below the crest of the log support wheels on the shaft closest the track to a position spaced inwardly from and above said carriage support track.

6. The log debarking apparatus as defined in claim 5 further comprising drive shaft means mounted on said carriage for rotation about an axis parallel to said carriage support track, motor means for driving said shaft, belt means driven by said drive shaft for rotating said debarking tool, and bearing means supporting said tool support arm means for pivotal movement about the axis of said drive shaft.

7. The log debarking apparatus as defined in claim 1 wherein said carriage support track has a top surface substantially in the configuration of an inverted V, and wherein said carriage support wheels each have a substantially V-shaped groove in their outer rims for engaging the V-shaped top surface of said carriage support track.

8. A log debarking apparatus comprising, an elongated rigid structural frame, log supporting and turning means on said structural frame for supporting a log at a substantially fixed location while rotating the log about is axis, a driven rotary debarking tool for removing bark from a log being rotated on said supporting and turning means, a debarker tool carriage supporting the debarking tool for movement along the length of a log being rotated on the log supporting and turning means, track means for supporting the carriage for movement along a path substantially parallel to and spaced from a log on said log supporting and turning means, said track means including an elongated structural assembly extending along one side of said structural frame and being fabricated from a plurality of structural steel shapes including a structural channel having its flanges disposed in a horizontal plane, a first structural angle extending along the top surface of the top flange of said channel, said first structural angle having the free edges of is legs resting upon and rigidly welded to said top flange and the upwardly directed surfaces of the legs defining a single upwardly directed carriage support track substantially in the configuration of an inverted V, and a structural member rigidly mounted on said structural channel and projecting downwardly from the bottom flange thereof, said structural member having substantially vertically extending planar side surfaces defining lateral stabilizing guide means, said debarker tool carriage including a carriage frame, a pair of carriage support wheels having substantially V-shaped grooves in their outer rims and being mounted in tandem on said carriage frame in position to engage said substantially V-shaped top surface of said single carriage support track to support said carriage for movement therealong, movable tool support arm means mounted on said carriage frame above said carriage support wheels and projecting laterally from said track means in position to support the debarker tool above said structural frame, and guide follower means on said carriage frame and engaging said lateral stabilizing guide means, said lateral stabilizing guide means and said guide follower means cooperating with said single carriage support track and said carriage support wheel to stabilize the carriage against tilting movement about said single carriage support track, and means for driving the carriage along said carriage support track.

9. The log debarking apparatus as defined in claim 8 further comprising plate means extending between and rigidly welded to the free edges of the horizontally extending flanges of said structural channel and cooperating therewith to define a generally rectangular tubular structural assembly.

10. The log debarking apparatus as defined in claim 9 wherein said lateral stabilizing guide means comprises a second structural angle having one leg rigidly welded to said bottom flange of said structural channel and having its other leg extending vertically downward therefrom, and wherein said guide follower means comprises a pair of roller means mounted on said carriage frame with one of said rollers engaging each lateral surface of said vertically extending leg.

11. The log debarking apparatus as defined in claim 10 further comprising vertical hold-down means for retaining said carriage support wheels against substantial vertical movement relative to said track means, the contoured track surface and the contoured rims on said carriage support wheels cooperating with said vertical hold-down means to maintain said carriage support wheels on said carriage support track.

12. The log debarking apparatus as defined in claim 11 wherein said log supporting and rotating means comprises a pair of elongated shafts mounted on said structural frame in laterally spaced parallel relation to one another and to said carriage support track and a plurality of log support wheels mounted on each of said elongated shafts, said apparatus further comprising log removing means for engaging and pushing a log from the supporting and rotating means over the crest of the log support wheels mounted on the shaft closest said track means.

13. The log debarking apparatus as defined in claim 12 wherein said carriage support track is spaced below the crest of said log support wheels, and wherein said apparatus further comprises ramp means extending from a position below the crest of the log support wheels on the shaft closest the track to a position spaced inwardly from and above said carriage support track.

14. The log debarking apparatus as defined in claim 13 further comprising drive shaft means mounted on said carriage for rotation about an axis parallel to said carriage support track, motor means for driving said shaft, belt means driven by said drive shaft for rotating said debarking tool, and bearing means supporting said tool support arm means for pivotal movement about the axis of said drive shaft.

15. The log debarking apparatus as defined in claim 14 wherein said bearing means supporting said tool support arm comprises a tubular sleeve, bracket means mounting said tubular sleeve on said carriage, and journal means supporting said tool support arm on said tubular sleeve for limited pivotal movement thereon, said drive shaft extending through said tubular sleeve in spaced coaxial relation therewith.

* * * * *